US005782043A

United States Patent [19]

Duncan et al.

[11] Patent Number: 5,782,043

[45] Date of Patent: Jul. 21, 1998

[54] SEISMIC CORRECTION SYSTEM FOR RETROFITTING STRUCTURAL COLUMNS

[76] Inventors: C. Warren Duncan, 1281 Logan Ave., Suite F, Costa Mesa, Calif. 92626; Richard G. Meehan, 25255 Cabot Rd., Suite 102, Laguna Hills, Calif. 92653

[21] Appl. No.: 752,051

[22] Filed: Nov. 19, 1996

[51] Int. Cl.[6] ..... E02D 27/34

[52] U.S. Cl. ..... 52/167.1; 254/106; 52/167.4; 52/745.17

[58] Field of Search ..... 52/167.1, 167.4, 52/745.17; 254/104, 106; 33/404–406

[56] References Cited

U.S. PATENT DOCUMENTS

| | | | |
|---|---|---|---|
| 3,101,184 | 8/1963 | Allen et al. | 33/404 |
| 3,468,514 | 9/1969 | Vaessen | 254/104 |
| 3,565,400 | 2/1971 | Yamuru | 254/106 |

*Primary Examiner*—Carl D. Friedman
*Assistant Examiner*—Yvonne Horton-Richardson
*Attorney, Agent, or Firm*—Charles H. Thomas

[57] ABSTRACT

A system is provided for relieving the downwardly acting load on a structural column, such as a reinforced concrete column supporting a roadway, bridge, overpass, or other massive structure. Horizontally oriented keyways are formed into the concrete column on transversely opposite sides thereof and at the same elevation thereon. The keyways are of rectangular cross section. Clamps likewise having vertical bearing surfaces and keys that extend horizontally with a corresponding rectangular cross section are clamped against the transversely opposite sides of the columns so that keys project into the keyways. A load bearing support system is positioned beneath the clamps. The bolts are torqued to tighten the clamps and hydraulic jacks are inserted in between the lowermost clamps and the load-bearing support structure to exert vertically upwardly acting forces against the clamps. These vertical forces counter the load on the column, thereby preloading the column. This reduces the vertically downwardly acting load on the column beneath the level of the clamps so that the base of the column can be retrofitted to withstand major seismic events.

11 Claims, 5 Drawing Sheets

SEISMIC CORRECTION SYSTEM FOR RETROFITTING STRUCTURAL COLUMNS

BACKGROUND OF THE INVENTION

1. Field of the Invention

The present invention relates to a method and apparatus for relieving the load on a structural column during seismic retrofitting and other remedial measures applied to structural columns or the footings or piles supporting such columns.

2. Description of the Prior Art

It has become increasingly evident to structural engineers that civil engineering structural techniques and specifications that were once thought to be acceptable have proven inadequate for withstanding major seismic events, such as major earthquakes. As a consequence, it has become necessary to retrofit vertical supporting columns for highways, bridges, trestles, stadium supports, and other massive structures to prevent such columns from collapsing should a major seismic even occur in their vicinity. To perform such remedial measures it is necessary to relieve the vertically downwardly directed load on a column below a predetermined location to reduce the load acting through the column into the base or footing therebeneath. Once the load, or at least a major portion of the load has been transferred to other supporting members, the column base, footing, or other underlying support can be reinforced and upgraded so as to provide protection to the column from future seismic events. By relieving the base of a column from the normal downwardly directed load thereon, additional or replacement concrete footings can be poured and cured and other measures taken to reinforce the column.

Currently the most common conventional method of providing relief to a column from the normal vertically acting, downwardly directed load thereon is to provide temporary or even permanent load-bearing supports immediately adjacent to the column to be structurally retrofitted, and to transfer the load from the column to the new structural load-bearing supports. This is conventionally done by attaching to the column steel jaws or a collar. The jaws or collar are clamped tightly to the column with very large, horizontally directed, compressive forces. Conventional systems rely on friction to prevent the column from sliding down through the jaws or collar.

The primary disadvantage of the conventional, frictional gripping arrangement in structurally retrofitting columns is that the coefficient of friction between the collar and the concrete surface of the column to be structurally reinforced normally is not more than one-half the clamping force. To achieve even a coefficient of friction where $\mu$ equals 0.5 requires additional surface preparation of the concrete column to increase the coefficient of friction between the concrete column and the steel collar pressed against it. Even with such additional surface preparation, the clamping force must be at least twice the vertical load transmitted down the column. This often requires a very massive collar and a considerable number of high-strength bolts to clamp the collar against the column.

Quite often, however, there is simply not enough space available between the column to be retrofitted and adjacent obstacles, columns or the temporary support structures utilized to accommodate the necessary number of bolts and the maneuvering room required to install and use conventional clamping devices. For a 260 kip load, for example, six sets of clamps employing a dozen bolts in total may be required. In addition, the expenses of providing the necessary massive collar of conventional design and the number of high-strength bolts required to exert the necessary clamping force is quite considerable. As a consequence, conventional clamping systems have proven unsatisfactory to date.

SUMMARY OF THE INVENTION

According to the present invention, on the other hand, a technique is provided which allows the vertically downwardly directly load of a column to be transferred to adjacent load-bearing supports utilizing a new clamping technique and apparatus which is far smaller and more compact than has heretofore been available. According to the principle of the invention, a small, horizontally oriented metal key is securely attached to the clamping elements employed, typically by welding throughout. Small, relatively shallow, horizontally oriented keyways are then milled into opposite sides of the concrete column. The keyways are of a size only slightly greater than the cross sections of the keys, so that the metal keys fit snugly into the keyways.

The clamps are then disposed on transversely opposite sides of the column and clamped together. For a column with a 260 Kip load only two pairs of clamps are necessary to grip the column. Upwardly acting forces are then exerted from the bearing supports against the clamps to counter the load on the column and to relieve the column from that load below the level of the clamps.

By employing the system of the invention the clamps can easily resist a downward load on the column of more than twice the clamping force exerted between the clamps. As a consequence, the system of the present invention is at least four times as effective as a standard friction collar. Furthermore, no additional surface preparation to the concrete is required utilizing the method and apparatus of the invention.

The keys and keyways employed according to the system of the invention are preferably rectangular in cross section and are horizontally oriented. Also, the surface of the clamp from which the key protrudes in a transverse direction is preferably a surface that conforms to the outer surface configuration of the column and resides in intimate contact therewith immediately above the location of the key. As a consequence, the vertical surfaces of the clamps immediately above the keys confine the concrete located immediately above the keyways and prevent the concrete above the keyways from spauling away.

Irrespective of the condition of the concrete, with a sufficient clamping force, the concrete immediately above the keyways is confined between the opposing clamps and provides resistance to the downward load on the column even if the concrete in these regions turns to a powder or liquid-like substance, since even then it is still incompressible. As a result, even with a very small keyway in the concrete a much larger load can be transmitted into the clamps than is possible using conventional techniques and equipment.

The depth of the keyway does not have any serious deleterious effect on the strength of the concrete column. Each keyway is typically approximately one-half to three-quarters of an inch deep, which is less than the concrete cover that surrounds the reenforcing steel rebar rods in reinforced concrete columns of conventional construction. Indeed, the concrete that covers the steel in columns is typically not even considered in structural strength calculations for concrete reinforced columns employed in overpasses, bridges, elevated roadways, and the like. Rather, only the strength of the reinforcing steel is considered.

Following the retrofitting operation, the keyways defined in the concrete of the column can simply be left open, as they do not seriously affect the structural strength of the column. Alternatively, if the requirement for corrosion protection or aesthetic considerations dictate filling in the keyways, the repair can be performed easily with epoxy or nonshrink concrete.

In one broad aspect the present invention may be considered to be a method for reducing a vertically downwardly acting load on a column below a predetermined location thereon. According to the method a horizontally oriented keyway is defined into the column on transversely opposite sides thereon at equal distances above the predetermined location on the column. Opposing clamping elements having horizontally oriented keys thereon are then positioned in a horizontal orientation against the transversely opposite sides of the column so that the keys project into the keyways. Horizontal compressive forces are then exerted against the clamping elements to press the keys into the keyways and to urge the clamping elements against the transversely opposite sides of the column. Load-bearing supports are anchored to the ground vertically beneath the clamping elements. Vertical forces are then exerted downwardly against the load-bearing supports and upwardly against the clamping elements to oppose the vertically downwardly acting load. This transfers at least a portion of the vertically downwardly acting load from the column to the load-bearing supports.

Preferably the clamping elements include vertical bearing surfaces that extend upwardly above the keys so that they keys project horizontally outwardly from beneath these vertical bearing surfaces. The vertical bearing surfaces are configured to conform to the shape of the column. For columns that are square or rectangular, the vertical bearing surfaces will be flat, planar, vertical surfaces. Where the column is of a cylindrical shape, the vertical bearing surfaces on the clamps will be curved concave outwardly to conform to the radius of curvature of the column.

In any event, the horizontal, compressive forces are exerted so that the vertical bearing surfaces of the clamping elements are clamped against the transversely opposite sides of the column. Thus, the vertical bearing surfaces of the clamps above the keys thereon holds the concrete above the keyways in place so that the concrete in those regions resists the downward force of the load on the column and cannot give way above the keyways even if the concrete above the keys is crushed. Rather, the confined concrete remains in position to provide abutments against which the upper horizontal surfaces of the keys bear.

Depending upon the load on the column, more than one set of clamps may be required. If so, each successive pair of clamps is position atop the clamps of the pair beneath separated therefrom by sets of wedges. The wedges serve to increase the distance between vertically separated keyways. All of the clamps have their own, separate keys, and horizontally oriented, vertically spaced keyways are defined in the transversely opposing surfaces of the column to accommodate the keys of each of the clamps.

In another broad aspect the invention may be considered to be an apparatus for supporting the load on a column so as to reduce a vertically downwardly acting load on the column below a predetermined location thereon. The apparatus of the invention is comprised of a pair of horizontally oriented clamps disposed on opposite transverse sides of the column and extending laterally beyond the column on laterally opposites sides thereof. Each of the clamps includes a horizontally oriented key projecting therefrom. The horizontally oriented keys of the clamps on opposite sides of the columns face each other and project into horizontally oriented keyways defined into the columns on the transversely opposite sides thereof above the predetermined location at which the load is to be reduced.

At least one pair of laterally separated, horizontally oriented, mutually parallel clamping bolts are provided. The clamping bolts extend transversely between the clamps adjacent the laterally opposite sides of the column. Typically, only a single pair of high-strength bolts are required for each pair of clamps. The bolts are tightened to draw the clamps toward each other and into compression against the opposite transverse sides of the column. Load-bearing supports are located vertically beneath each of the clamps and are anchored to transmit vertically downwardly existing loads thereon to ground.

Sets of jacks are provided which act between the load-bearing supports and each of the columns. The jacks are actuated to exert vertically upwardly acting forces against the clamps to counter the load on the column. This reduces the vertically downwardly acting load on the column beneath the level of the clamps.

The invention may be described with greater clarity and particularity by reference to the accompanying drawings.

DESCRIPTION OF THE EMBODIMENT AND IMPLEMENTATION OF THE METHOD

Figure 1:
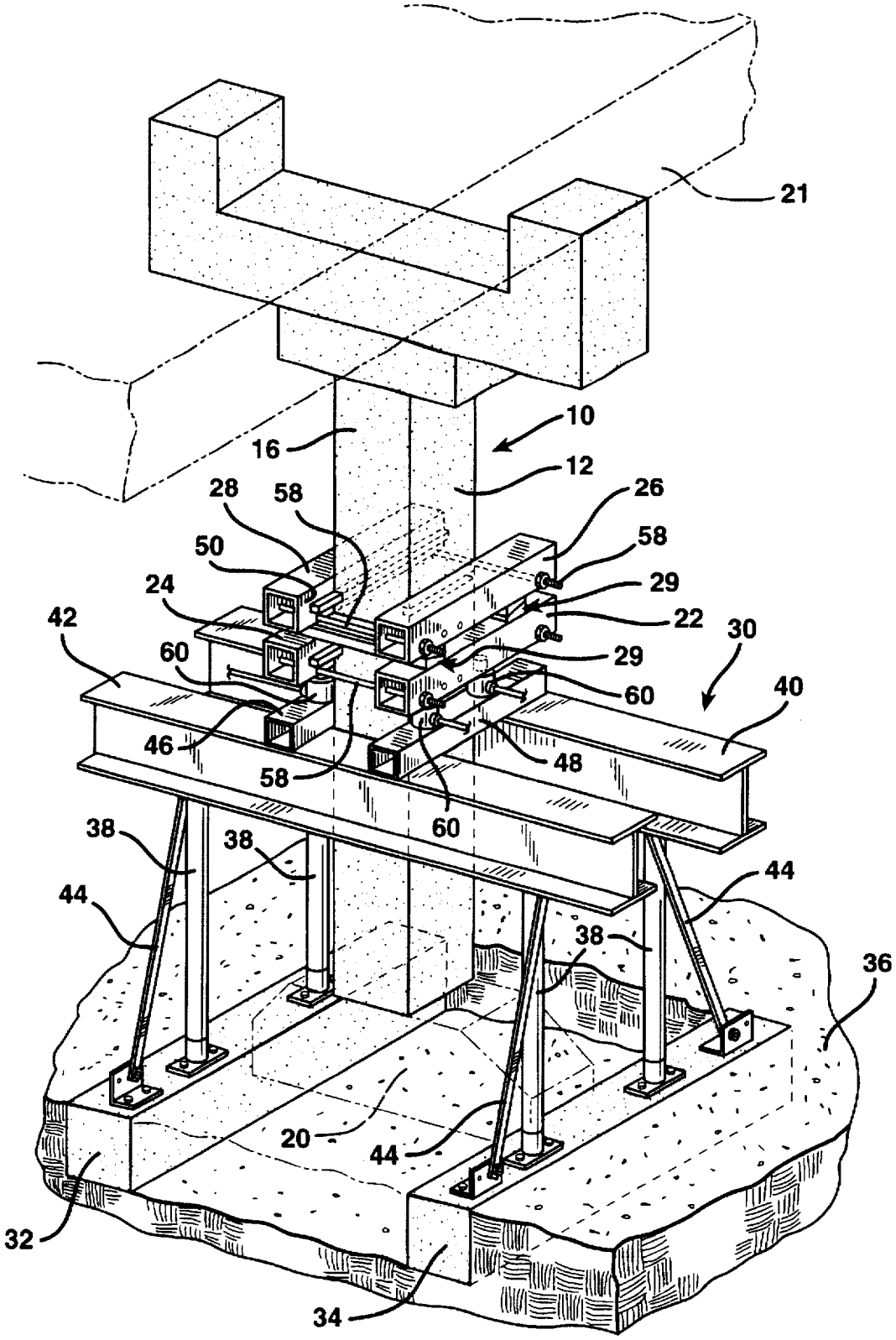
FIG. 1 is a perspective view illustrating operation of the system of the invention.

FIG. 1 illustrates a precast, prestressed, rectangular, reinforced concrete pile or column 10. The column 10 may, for example, be of a square cross section measuring fourteen inches between each of its transversely opposite sides 12 and 14 and fourteen inches between each of its laterally opposite sides 16 and 18. The column 10 rests on a footing 20 and supports a roadway, indicated in phantom at 21. The column 10 is internally reinforced with three-eighths inch rebar rods throughout its length.

The anticipated vertically downwardly acting dead load on the shoring column 10 may, for example, be about 300 kips. Accordingly, to relieve this load two pairs of friction collars or clamps, each rated at 150 kips per set are selected for this column configuration. Clamps 22 and 24 are provided for the lowermost pair of clamps, while clamps 26 and 28 are provided as an uppermost pair of clamps. Adjustable steel wedge sets 29 are located between the clamps 22 and 26 and between the clamps 24 and 28 near each of the corners of the column 10 to aid in equalizing the load acting on the pairs of clamps.

A load-bearing support structure indicated generally at 30 is provided as the structure to which the vertical load on the column 10 is to be transferred. The load-bearing structure 30 includes a pair of temporary footings 32 and 34 located a distance of about twelve feet apart, center to center. Each of the footings 32 and 34 is about seven feet in length, in excess of two feet in width, and about three feet in height. The footings 32 and 34 are reinforced with three-eighths inch rebar and are poured below the grade of the original footing 20 for the column 10 that is to be retrofitted.

The load-bearing support structure 30 is anchored to the ground 36 by means of the temporary footings 32 and 34. Tubular steel posts 38 extend vertically upwardly from the temporary footings 32 and 34 and are anchored by bolts at their lower extremities into the footings 32 and 34. The posts 38 are each formed with steel walls one-half of an inch in thickness and measure six inched in diameter. The posts 38 support a pair of wide flange beams 40 and 42 that are horizontally oriented and extend transversely relative to the alignment of the footings 32 and 34. The wide flange beams 40 and 42 are typically W24X68 and are secured to the tops of the posts 38 by welding thereto. Inclined braces 44 are also anchored to the temporary footings 32 and 34 by bolts and are likewise welded to the wide flange beams 40 and 42.

Atop the wide flange beams 40 and 42 and extending perpendicular thereto in mutually parallel alignment alongside the transversely opposite sides 12 and 14 are a pair of square steel tubes 46 and 48. The square tubes 46 and 48 are formed of one-quarter inch thick steel having a square, tubular outer dimension of four inches on a side.

Each of the clamps 22, 24, 26, and 28 is formed of tubular steel having a rectangular cross section. The wall thickness of each of the faces of the clamps 22, 24, 26, and 28 is one-quarter inch. Each clamp is formed of two L6X6-⅛ angles welded together to form a box section. Stiffening partition plates 31 are welded inside each of the clamps 22, 24, 26, and 28 six inches in from both ends to add rigidity to the clamp structure. The mutually facing, vertical surfaces 50 of the clamps 22, 24, 26, and 28 are all six inches wide by forty-five inches in length. Extending along the center of each of the surfaces 50 of the clamps is an elongated, rectangular, steel strip 52, preferably between one-quarter and three-quarters of an inch in vertical height, about one-half inch in horizontal width, and about thirty-eight inches in length. The steel strips 52 are welded to the surfaces 50 of the clamps 22, 24, 26, and 28 with upper and lower horizontal welds extending the entire lengths of the steels strips 52 where they meet the surfaces 50 of the clamps 22, 24, 26, and 28. When welded in place the steel strips 52 serve as keys that will fit into keyways in the column 10.

Sets of coaxially aligned bolt openings 33 are formed two inches above the bottom surface 51 through both the inwardly facing, vertical surface 50 and the opposite, outwardly facing, vertical surface 53 of each of the clamps 22, 24, 26, and 28. A first set of bolt openings 33 is formed three inches from one end of each clamp, while sets of openings 33 spaced fifteen, twenty-one, twenty-seven, thirty-three, and thirty nine inches from the first set are formed toward the opposite end of each clamp.

Two horizontal channels 56 are milled into each of the transverse sides 12 and 14 of the shoring column 10. The channels 56 are of rectangular cross-sectional configuration and are of a size to serve as keyways to snugly receive the rectangular keys 52 therewithin. The keyways 56 are formed in pairs at the same elevations on the column 10 on each of the transverse sides 12 and 14 thereof. The uppermost pair of keyways 56 is separated from the lowermost pair of milled keyways by a distance of six inches. The keyways 56 extend laterally and are horizontally oriented above the location to be isolated from the vertically downwardly acting load on the column 10, namely the footing 20.

Figure 2:
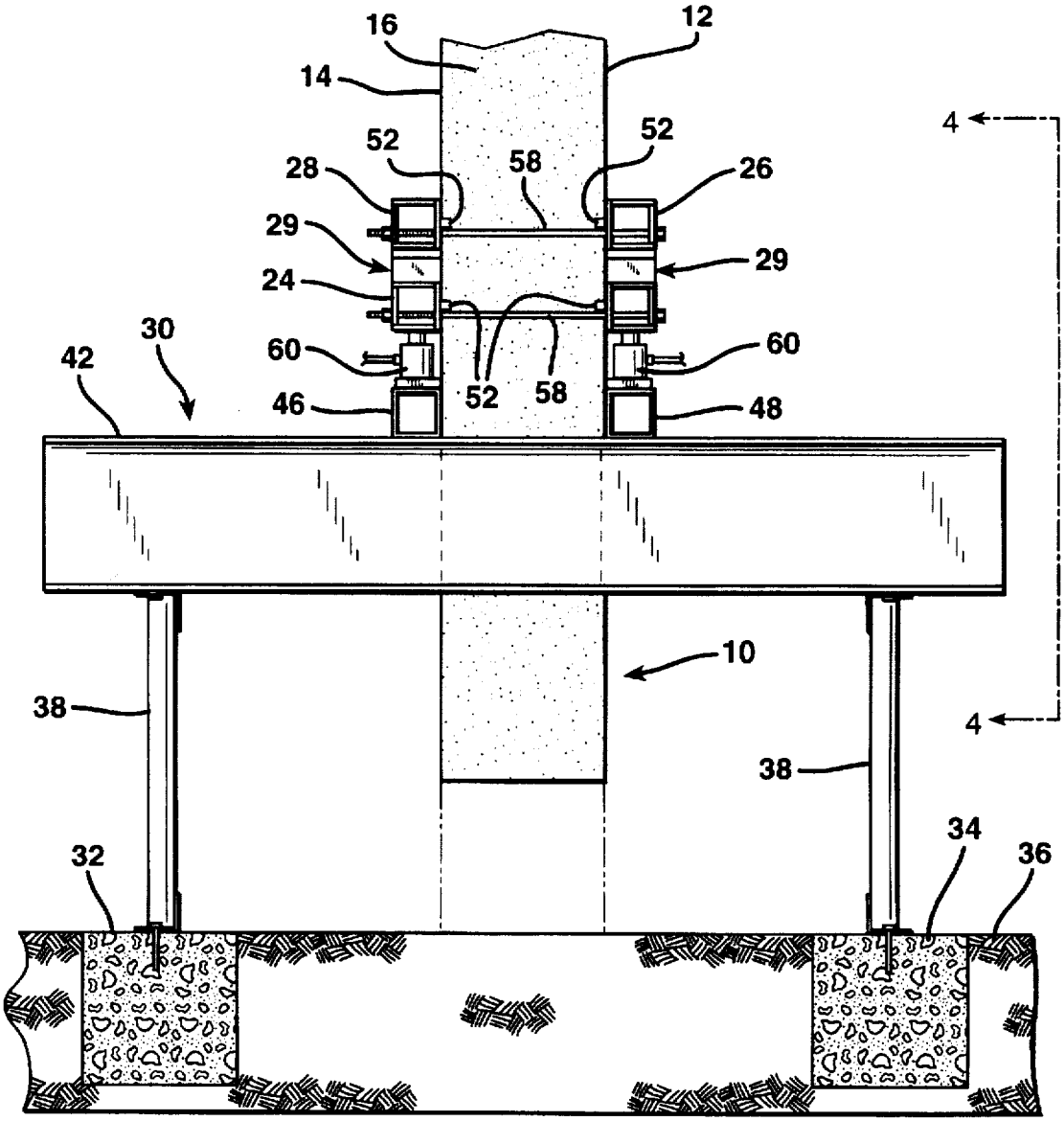
FIG. 2 is a side elevational view from one of the laterally opposite sides of the column shown in FIG. 1.
Figure 4:
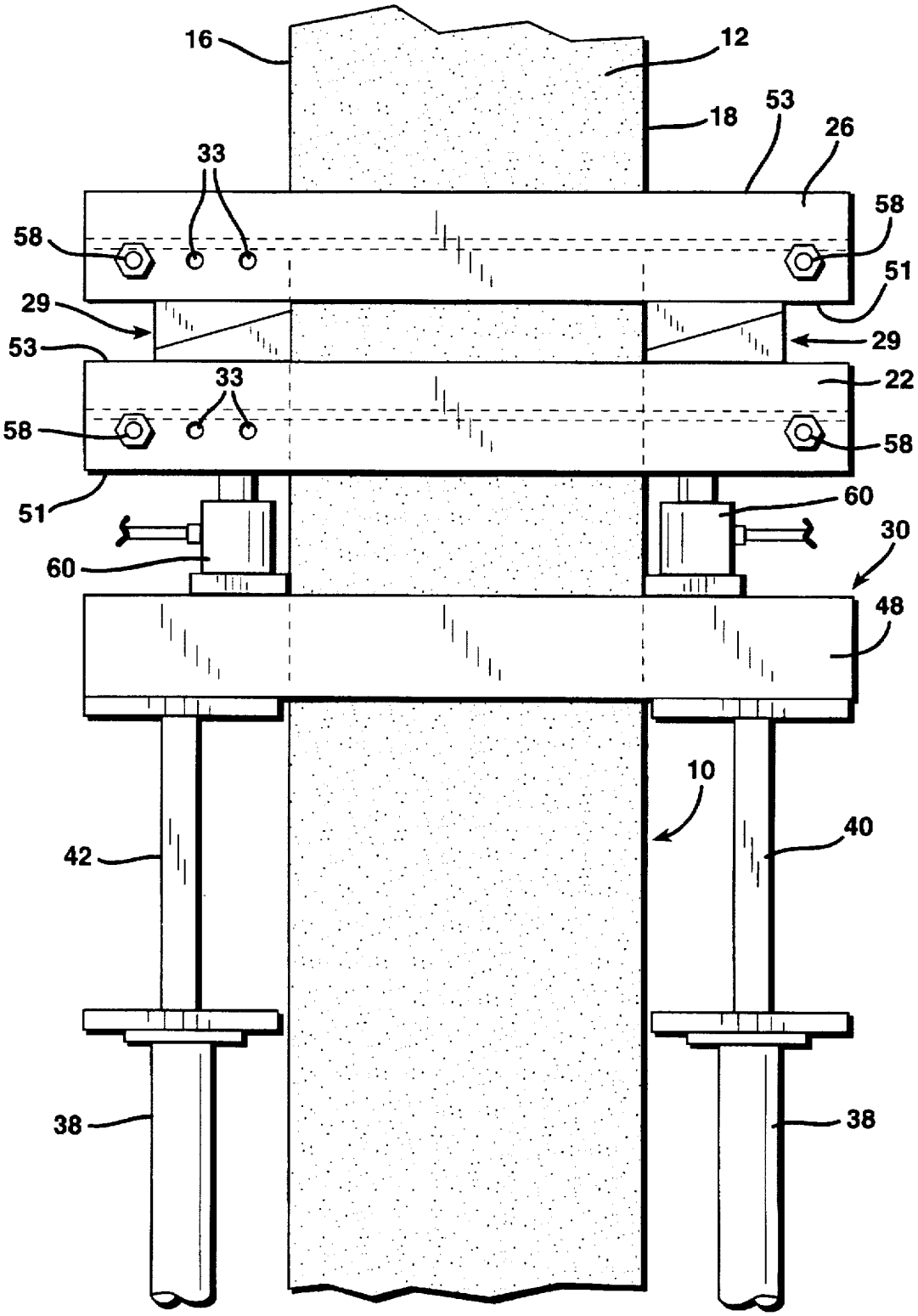
FIG. 4 is a side elevational view from one of the transversely opposite sides of the column of FIG. 1.
Figure 5:
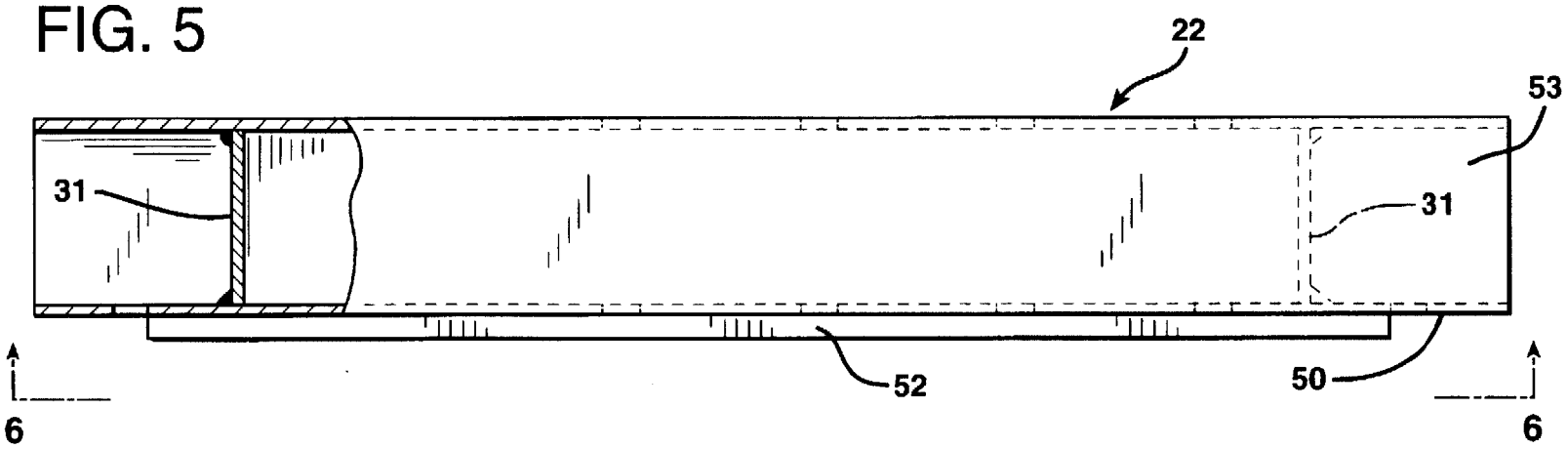
FIG. 5 is a top plan view, partially broken away, showing a single one of the clamps of the system of the invention in isolation.
Figure 6:
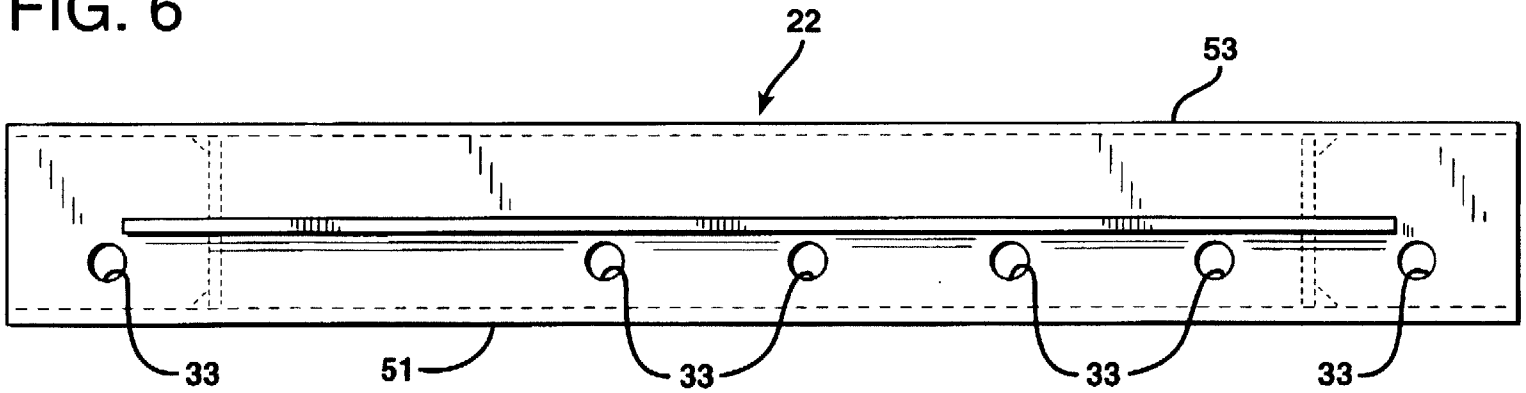
FIG. 6 is an elevational view taken along the lines 6—6 of FIG. 5.

The clamps 22, 24, 26, and 28 are then brought into the positions indicated in FIGS. 1, 2, and 4. With the clamps in these positions, the surfaces 50 form vertical bearing surfaces from which the keys 52 extend inwardly. The clamps 22, 24, 26, and 28 reside in a horizontal orientation against the transversely opposite sides 12 and 14 of the column 10 so that the ends of the clamps extend laterally beyond the column 10 past both the laterally opposite sides 16 and 18 thereof. The keys 52 of each pair of clamps face each other and project into their respective keyways 56.

The clamps in each pair are then secured together by one and one-quarter inch diameter high-strength bolts 58. The bolts 58 are tightened with an equal torque to exert equal, horizontally acting, transversely directed clamping forces against the clamps on both of the laterally opposite sides 16 and 18 of the column 10, thereby pressing the keys 52 into the keyways 56 and urging the clamps 22, 24, 26, and 28 toward each other and tightly against the transversely opposite sides 12 and 14 of the column 10.

Figure 3:
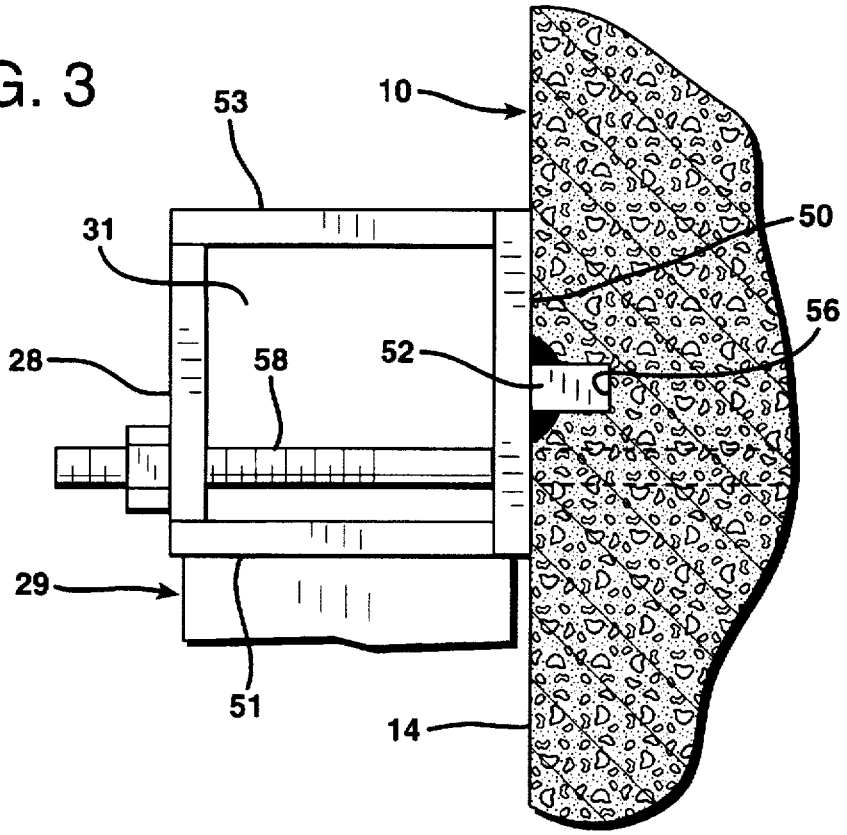
FIG. 3 is a detail of one of the clamps shown in FIG. 2.
Figure 7:
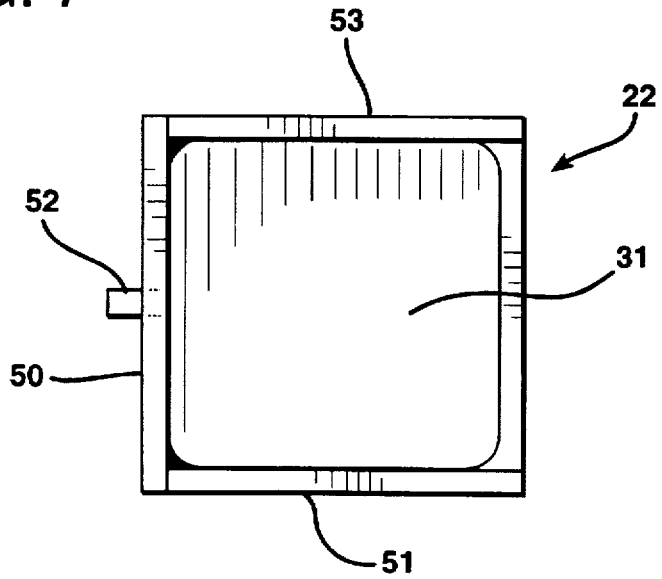
FIG. 7 is an end view of the clamp of FIG. 6.

As best illustrated in FIG. 3, each of the surfaces 50 of each of the clamps 22, 24, 26, and 28 forms a flat, vertical bearing surface extending upwardly from the horizontally extending key 52 welded thereto. The clamping bolts 58 thereby press the vertical bearing surfaces 52 against the opposite, transverse sides 12 and 14 of the column 10 directly above the keyways 56.

The downwardly acting load on the column 12 tends to push the clamps 22, 24, 26, and 28 outwardly away from the transverse sides 12 and 14 of the column 10. The compressive force applied by the bolts 58, the shanks of which are under extreme longitudinal tension, resists the downward force on the column 10 in this regard. Also, the downward force on the column 10 exerts a shearing action between the keys 52 and the vertical bearing surfaces 50. However, the longitudinal, linear welds holding the keys 52 to the faces 50 are strong enough so as not to be broken by this shearing force.

Four calibrated, fifty-ton hydraulic jacks 60 are interposed between the load-bearing support 30 and the clamps 22, 24, 26, and 28. Specifically, a separate jack 60 is positioned proximate each of the four vertical edges of the column 10 vertically beneath the clamps 22, 24, 26, and 28 and directly beneath the wedge sets 29. The jacks 60 rest upon the square tubes 46 and 48. The jacks are all connected to a common manifold to ensure that the forces which they exert are equal.

To transfer the downward load from the column 10 to the load-bearing supports structure 30, hydraulic fluid under pressure is forced into the jacks 60 in 15 kip increments to ensure that equal, simultaneous force is applied to all four contact points of the clamps 22, 24, 26, and 28. Hydraulic fluid under pressure is forced into the hydraulic jacks 60 until a vertical displacement of one-eighth of an inch appears between the column 12 and the footing 20.

Once the preload is applied to the column 10 using the jacks 60, a second set of wedges 29 (not shown) is then driven in between the lowermost clamps 22 and 24 and the box beams 46 and 48 therebeneath. A separate wedge set is driven into position as close as possible to each of the jacks 60 prior to removal of the jacks 60. The wedge sets between the clamp 22 and box beam 48 and between the clamp 24 and the box beam 46 serve to maintain the preload on the system prior to removal of the jacks 60. Once these wedges are in position, the jacks 60 can be removed for use elsewhere.

At this point the load on the column 10 below the lowermost pair of clamps 22 and 24 is negligible. The footing 20 then can be removed and replaced with a system retrofitted to withstand major seismic events.

Undoubtedly, numerous variations and modifications of the invention will become readily apparent to those familiar with static and dynamic forces on structural columns employed in civil engineering projects. In the example depicted and described the column 10 is of a square cross-sectional configuration. However, the invention may also be adapted for use with cylindrical columns. In such a system clamps of a generally semicircular configuration having a curvature matching that of the column can be employed. The keys on the vertical bearing surfaces of the clamps would also be arcuate in configuration, as would the keyways formed into the column. The clamps in such a system could be bolted at both ends as in the embodiment described herein or they could be hinged on one lateral side of the column and bolted together on the other to achieve the necessary clamping force. Accordingly, the scope of the invention should not be construed as limited to the specific embodiment and implementation depicted and described.

We claim:

1. A method for reducing a vertically, downwardly acting load on a column below a predetermined location thereon comprising:

defining a horizontally oriented keyway into said column on transversely opposite sides thereof at equal distances above said predetermined location thereon, positioning opposing clamping elements having horizontally oriented keys thereon in a horizontal orientation against said transversely opposite sides of said column so that said keys project into said keyways, exerting horizontal compressive forces against said clamping elements to press said keys into said keyways and to urge said clamping elements against said transversely opposite sides of said column, positioning load-bearing supports anchored to the ground vertically beneath said clamping elements, and exerting vertical forces downwardly against said load-bearing supports and upwardly against said clamping elements to oppose said vertically downwardly acting load, thereby transferring at least a portion of said vertically downwardly acting load from said column to said load-bearing supports.

2. A method according to claim 1 further characterized in that said clamping elements include vertical bearing surfaces extending upwardly above said keys and further comprising exerting said horizontal compressive forces so that said vertical bearing surfaces of said clamping elements are clamped against said transversely opposite sides of said column.

3. A method according to claim 2 further comprising interpositioning hydraulic jacks between said load-bearing supports and said clamping elements, wherein said vertical forces are exerted by forcing hydraulic fluid under pressure into said hydraulic jacks.

4. A method for reducing a vertically downwardly acting load on a column below a predetermined location thereon comprising:

defining laterally extending, horizontally oriented keyways into said column on transversely opposite sides thereof a selected distance above said predetermined location thereon, positioning at least one pair of clamps having laterally extending keys thereon in a horizontal orientation against said transversely opposite sides of said column so that said clamps extend laterally beyond said column on laterally opposite sides thereof and so that said keys face each other and project into said keyways, exerting equal horizontally acting transverse clamping forces on said clamps on both of said laterally opposite sides of said column, thereby pressing said keys into said keyways and urging said clamps against said transversely opposite sides of said column and toward each other, anchoring load-bearing supports to the ground vertically beneath said clamps, and exerting equal forces from said load-bearing supports vertically upwardly against both of said clamps on both of said laterally opposite sides of said column to an extent sufficient to counter at least a portion of said vertically downwardly acting load on said column and isolate it from acting downwardly on said column below said predetermined location thereon.

5. A method according to claim 4 further comprising positioning two pair of clamps as aforesaid, one pair above the other, and defining a pair of vertically spaced keyways into said column on each of said transversely opposite sides thereon, and exerting said forces from said load-bearing supports vertically upwardly against said clamps in both of said pairs of clamps.

6. A method according to claim 4 wherein each of said clamps is provided with a flat, vertical bearing surface directly above said key thereon, whereby said horizontally acting clamping forces serve to press said vertical bearing surfaces tightly against said transversely opposite sides of said column directly above said keyways.

7. A method according to claim 4 wherein said clamps are joined together with transversely extending bolts adjacent each of said laterally opposite sides of said column, and said horizontally acting, transverse clamping forces are exerted by tightening said bolts.

8. A method according to claim 7 wherein hydraulic jacks are interposed between said load-bearing supports and said clamps, and said forces from said load-bearing supports are exerted by forcing hydraulic fluid under pressure into said hydraulic jacks.

9. Apparatus for supporting the load on a column so as to reduce a vertically downwardly acting load on said column below a predetermined location thereon comprising: a pair of horizontally oriented clamps disposed on opposite transverse sides of said column and extending laterally beyond said column on laterally opposing sides thereof, each of said clamps including a horizontally oriented key projecting therefrom, whereby said horizontally oriented keys face each other and project into horizontally oriented keyways defined into said column on said transversely opposite sides thereof above said predetermined location thereon, at least one pair of laterally separated, horizontally oriented, mutually parallel clamping bolts extending between said clamps adjacent said laterally opposite sides of said column and tightened to draw said clamps toward each other and into compression against said opposite transverse sides of said column, load-bearing supports located vertically beneath each of said clamps and anchored to transmit vertically downwardly acting loads thereon to ground, and jacks acting between said load-bearing supports and each of said clamps and actuated to exert vertically upwardly acting forces against said clamps to counter at least a portion of said load on said column, thereby reducing said vertically downwardly acting load on said column beneath the level of said clamps.

10. Apparatus according to claim 9 wherein each of said keys and each of said keyways has a rectangular cross sectional shape.

11. Apparatus according to claim 10 wherein each of said clamps is configured with a flat, vertical bearing surface extending upwardly from said key thereon, whereby said clamping bolts press said vertical bearing surfaces against said opposite transverse sides of said column directly above said keyways.

* * * * *